US010655558B2

(12) United States Patent
Sakata et al.

(10) Patent No.: US 10,655,558 B2
(45) Date of Patent: May 19, 2020

(54) INTERNAL COMBUSTION ENGINE

(71) Applicant: TOYOTA JIDOSHA KABUSHIKI KAISHA, Toyota-shi, Aichi-ken (JP)

(72) Inventors: Kunihiko Sakata, Nagakute (JP); Atsushi Komada, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/193,457

(22) Filed: Nov. 16, 2018

(65) Prior Publication Data

US 2019/0195166 A1 Jun. 27, 2019

(30) Foreign Application Priority Data

Dec. 22, 2017 (JP) ..... 2017-246171

(51) Int. Cl.

| | |
|---|---|
| ***F02F 1/38*** | (2006.01) |
| ***F01P 3/02*** | (2006.01) |
| ***F02F 1/42*** | (2006.01) |
| ***F02F 1/40*** | (2006.01) |

(52) U.S. Cl.

CPC *F02F 1/38* (2013.01); *F01P 3/02* (2013.01); *F02F 1/40* (2013.01); *F02F 1/4214* (2013.01); *F01P 2003/024* (2013.01)

(58) Field of Classification Search

CPC .... F02F 1/38; F02F 1/4214; F02F 1/40; F01P 3/02; F01P 2003/024

See application file for complete search history.

(56) References Cited

U.S. PATENT DOCUMENTS 5,558,048 A * 9/1996 Suzuki ..... F02B 75/20 123/41.74

2002/0124815 A1 9/2002 Ishiguro et al.

FOREIGN PATENT DOCUMENTS

| | | |
|---|---|---|
| JP | 2002-256966 A | 9/2002 |
| JP | 2006-214304 A | 8/2006 |
| JP | 2015-113704 A | 6/2015 |

* cited by examiner

*Primary Examiner* — Jacob M Amick
*Assistant Examiner* — Charles Brauch
(74) *Attorney, Agent, or Firm* — Oliff PLC

(57) ABSTRACT

An internal combustion engine includes cylinders, a cylinder head that includes a pair of intake ports and a pair of exhaust ports for each of the cylinders, and a cylinder block that includes a block-side coolant passage. One of the pair of intake ports and the pair of exhaust ports is a pair of specified ports. The cylinder head includes an inter-port coolant passage between the specified ports. The inter-port coolant passage is connected to the block-side coolant passage through a communication portion. A flow direction is a direction in which the coolant flows in a portion of the block-side coolant passage that is connected to the communication portion. A center of a passage cross section of the communication portion is shifted to a downstream side in the flow direction with respect to a center of a passage cross section of the inter-port coolant passage.

8 Claims, 4 Drawing Sheets

INTERNAL COMBUSTION ENGINE

BACKGROUND

The present invention relates to an internal combustion engine.

Japanese Laid-Open Patent Publication No. 2002-256966 describes an example of a cylinder head of an internal combustion engine having multiple cylinders. The cylinder head includes a pair of intake ports and a pair of exhaust ports for each cylinder. The cylinder head includes an inter-port coolant passage between the paired exhaust ports. Coolant flows through the inside of the cylinder block and then into the inter-port coolant passage. The inter-port coolant passage is configured such that the coolant flows from an outer side toward an inner side in a radial direction with respect to the central axis of the cylinder. That is, the inter-port coolant passage includes a radial outer end. The radial outer end functions as an inlet part that allows the coolant to flow from the cylinder block into the inter-port coolant passage. Arrangement of such an inter-port coolant passage in the cylinder head may improve the cooling efficiency of a combustion chamber of the internal combustion engine.

If the amount of coolant flowing through the inter-port coolant passage is increased, the cooling efficiency of the combustion chamber may be enhanced. However, the inter-port coolant passage is arranged between paired exhaust ports, and thus it is difficult to increase the cross-sectional area of the inter-port coolant passage because of limitations imposed on the layout of the inter-port coolant passage. It is thus desirable to increase the flow rate of coolant in the inter-port coolant passage for the purpose of further enhancing the cooling efficiency of the combustion chamber.

SUMMARY

According to an aspect of the present invention, an internal combustion engine includes cylinders, a cylinder head that includes a pair of intake ports and a pair of exhaust ports for each of the cylinders, and a cylinder block that includes a block-side coolant passage. The cylinder head is configured to allow coolant to flow from the block-side coolant passage into the cylinder head. One of the pair of intake ports and the pair of exhaust ports is a pair of specified ports. The cylinder head includes an inter-port coolant passage between the specified ports. In the inter-port coolant passage, the coolant flows inward in a radial direction with respect to a central axis of each of the cylinders. The inter-port coolant passage is connected to the block-side coolant passage through a communication portion. A flow direction is a direction in which the coolant flows in a portion of the block-side coolant passage that is connected to the communication portion. A center of a passage cross section of the communication portion is shifted to a downstream side in the flow direction with respect to a center of a passage cross section of the inter-port coolant passage.

Unlike the configuration of the present invention, when the central axis of the communication portion, which connects the block-side coolant passage to the inter-port coolant passage, is not shifted with respect to the central axis of the inter-port coolant passage, flow of the coolant is readily disturbed in the part of the inter-port coolant passage connected to the communication portion. Such disturbance of the flow of the coolant in the inter-port coolant passage increases a pressure loss when the coolant flows into the inter-port coolant passage. Consequently, the flow rate of the coolant flowing from the block-side coolant passage into the inter-port coolant passage via the communication portion is reduced, and the flow rate of the coolant flowing through the inter-port coolant passage is reduced, accordingly.

In this regard, in the configuration of the present invention, the center of the passage cross section of the communication portion is shifted with respect to the center of the passage cross section of the inter-port coolant passage to the downstream side in the flow direction in which the coolant flows in the part of the block-side coolant passage connected to the communication portion. For this reason, when the coolant flows via the communication portion into the inter-port coolant passage, a swirl flow of coolant is readily generated along the peripheral wall of the inter-port coolant passage in the part of the inter-port coolant passage connected to the communication portion. That is, as compared to a case where the central axis of the communication portion is not shifted with respect to the central axis of the inter-port coolant passage, flow of the coolant is less disturbed in the part of the inter-port coolant passage connected to the communication portion. This reduces a pressure loss when the coolant flows into the inter-port coolant passage. Accordingly, the flow rate of coolant flowing through the inter-port coolant passage is increased. This ultimately enhances the cooling efficiency of a combustion chamber of the internal combustion engine.

According to an aspect of the present invention, the cylinder head may further include a surrounding coolant passage arranged around the central axis of the cylinder at an inner side of the communication portion in the radial direction. The inter-port coolant passage may include an upstream portion that is connected to the communication portion, an intermediate portion that is arranged at an inner side of the communication portion in the radial direction and connected to the upstream portion, the intermediate portion extending inward from the upstream portion in the radial direction, and a downstream portion that connects the intermediate portion to the surrounding coolant passage. With this configuration, when coolant flows into the inter-port coolant passage from the communication portion, the coolant flows through the upstream portion, the intermediate portion, and the downstream portion and then into the surrounding coolant passage. The upstream portion may include an inclined part connected to the intermediate portion. The inclined part may extend so as to be separated from the cylinder block toward the intermediate portion so that a central axis of the inclined part is inclined with respect to the central axis of the cylinder. An angle formed by the central axis of the cylinder and a central axis of the intermediate portion may be larger than an angle formed by the central axis of the cylinder and the central axis of the inclined part.

The cooling efficiency of the combustion chamber is enhanced by increasing the amount of coolant flowing in an area in the intermediate portion that is closer to the combustion chamber than the central axis of the intermediate portion. In this regard, in the configuration described above, the inclined part of the upstream portion is inclined with respect to the intermediate portion so that the angle formed by the central axis of the cylinder and the central axis of the intermediate portion is larger than the angle formed by the central axis of the cylinder and the central axis of the inclined part. Thus, the coolant flowing in the inclined part is guided to the area in the intermediate portion that is closer to the combustion chamber than the central axis of the intermediate portion by a part of the peripheral wall of the inclined part that is separated from the combustion chamber further than the central axis of the inclined part. This increases the amount of coolant flowing in the area in the intermediate portion that is closer to the combustion chamber than the central axis of the intermediate portion. Thus, the cooling efficiency of the combustion chamber is enhanced.

According to an aspect of the present invention, a cylinder arrangement direction is a direction in which the cylinders are arranged in the cylinder block. The cylinder head may include a port outer passage into which the coolant flows from the block-side coolant passage. The port outer passage and the inter-port coolant passage may be disposed at opposite sides of one of the specified ports in the cylinder arrangement direction. The inter-port coolant passage may include an upstream portion that is connected to the communication portion. The cylinder head may include a restriction portion defining the upstream portion and the port outer passage and restricting a flow of the coolant out of the upstream portion toward the port outer passage.

According to the configuration described above, when coolant flows into the upstream portion of the inter-port coolant passage through the communication portion, the restriction portion restricts outflow of the coolant to the port outer passage. This limits decreases in the amount of coolant flowing in the inter-port coolant passage and ultimately limits adverse effects on the cooling efficiency of the combustion chamber.

According to an aspect of the present invention, a cylinder arrangement direction is a direction in which the cylinders are arranged in the cylinder block. The inter-port coolant passage may include an upstream portion that is connected to the communication portion. The cylinder head may include a peripheral wall defining the upstream portion. The peripheral wall may include two side surfaces opposed to each other in the cylinder arrangement direction. Each of the two side surfaces may include a first end and a second end that is separated from the cylinder block further than the first end. The peripheral wall may further include a connecting side surface that connects the second ends of the two side surfaces. One of the two side surfaces may be a downstream side surface that is arranged at a downstream side in the flow direction. The downstream side surface may extend from the first end to the second end so as to be closer to a central axis of the upstream portion.

When coolant flows into the inter-port coolant passage through the communication portion, the coolant flows along the downstream side surface and then along the connecting side surface. When the coolant flows along the peripheral wall as described above, a swirl flow of coolant is generated in the upstream portion. According to the configuration described above, when the downstream side surface is inclined as described above, a pressure loss can be reduced when the flow direction of the coolant flowing along the downstream side surface is changed to a direction along the connecting side surface. This increases the flow rate of a swirl flow of the coolant in the upstream portion.

According to an aspect of the present invention, preferably, a gasket is arranged between the cylinder block and the cylinder head, and the gasket includes the communication portion.

According to an aspect of the present invention, preferably, the pair of specified ports is the pair of exhaust ports.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION

An embodiment of an internal combustion engine will be described below with reference to FIGS. 1 to 7.

Figure 1:
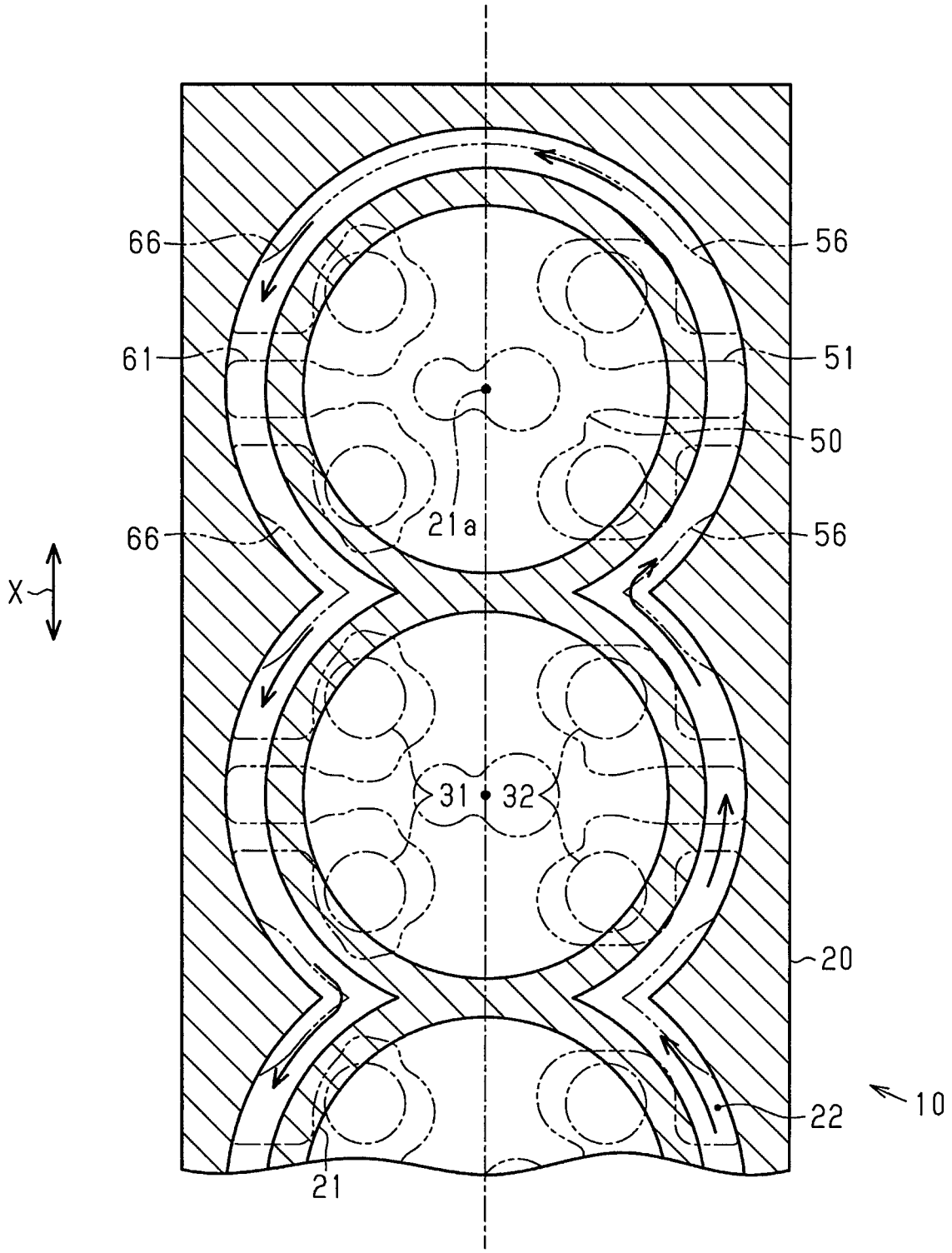
FIG. 1 is a structural diagram showing a positional relationship between a block-side coolant passage arranged in a cylinder block and a coolant passage arranged in a cylinder head according to an embodiment of an internal combustion engine.

FIG. 1 shows a part of a cylinder block 20 that is included in an internal combustion engine 10. As shown in FIG. 1, cylinders 21 are arranged in a line in the cylinder block 20. The direction in which the cylinders 21 are arranged in the cylinder block 20 is referred to as the "cylinder arrangement direction X." A block-side coolant passage 22 extends in the cylinder block 20 in a manner surrounding the cylinders 21. In the block-side coolant passage 22, coolant flows in a direction indicated by arrows in FIG. 1.

Figure 2:
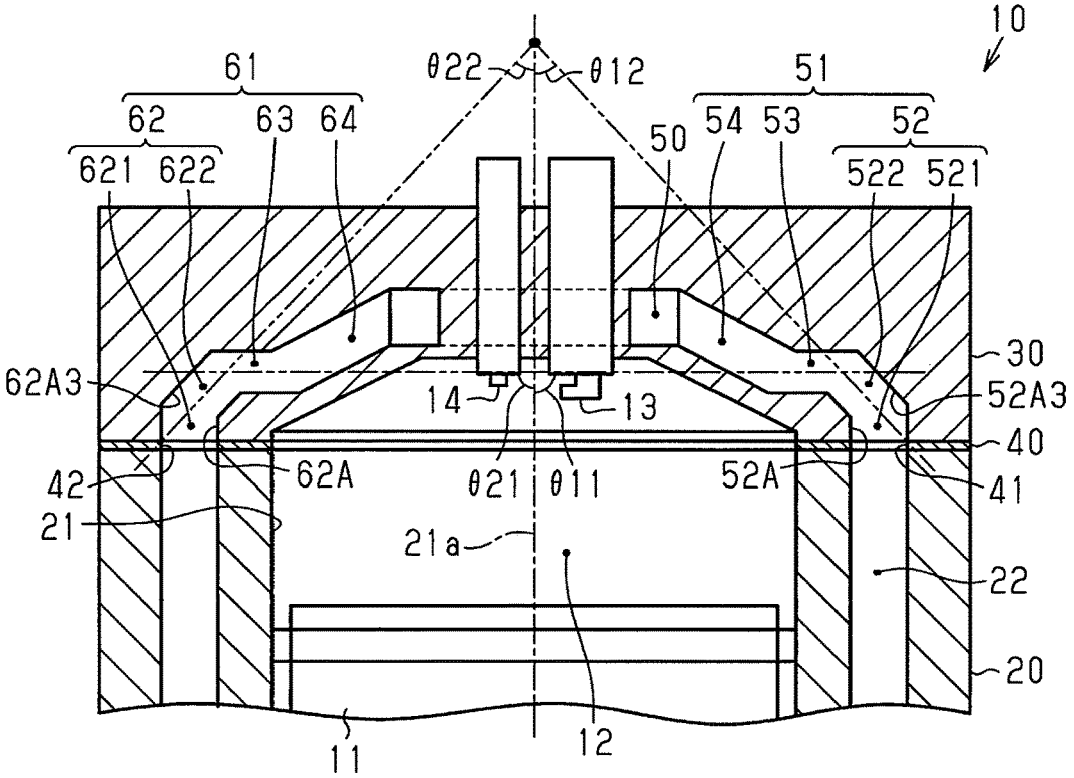
FIG. 2 is a cross-sectional view of the internal combustion engine including the cylinder block shown in FIG. 1.

As shown in FIG. 2, a cylinder head 30 is attached to the cylinder block 20. A gasket 40 is arranged between the cylinder head 30 and the cylinder block 20. In the cylinder head 30, a pair of intake ports 31 and a pair of exhaust ports 32 are formed for each cylinder 21, as shown by double-dashed lines in FIG. 1. That is, when there are an N number of cylinders 21, the cylinder head 30 includes N pairs of intake ports 31 and N pairs of exhaust ports 32. As shown in FIG. 2, a combustion chamber 12 is defined by each cylinder 21 of the cylinder block 20, the cylinder head 30, and a piston 11. Intake air is drawn from the pair of intake ports 31 to the combustion chamber 12. Exhaust produced in the combustion chamber 12 is discharged to the pair of exhaust ports 32. In the following description, the "radial direction," the "radially inward," and the "radially outward" are determined based on a central axis 21*a* of the cylinder 21.

In the internal combustion engine 10 of the present embodiment, ignition plugs 13 and fuel injection valves 14 are attached to the cylinder head 30. Specifically, the ignition plugs 13 and the fuel injection valves 14 are disposed between each pair of intake ports 31 and the corresponding pair of exhaust ports 32. That is, the internal combustion engine 10 is of a central injection type.

Figure 3:
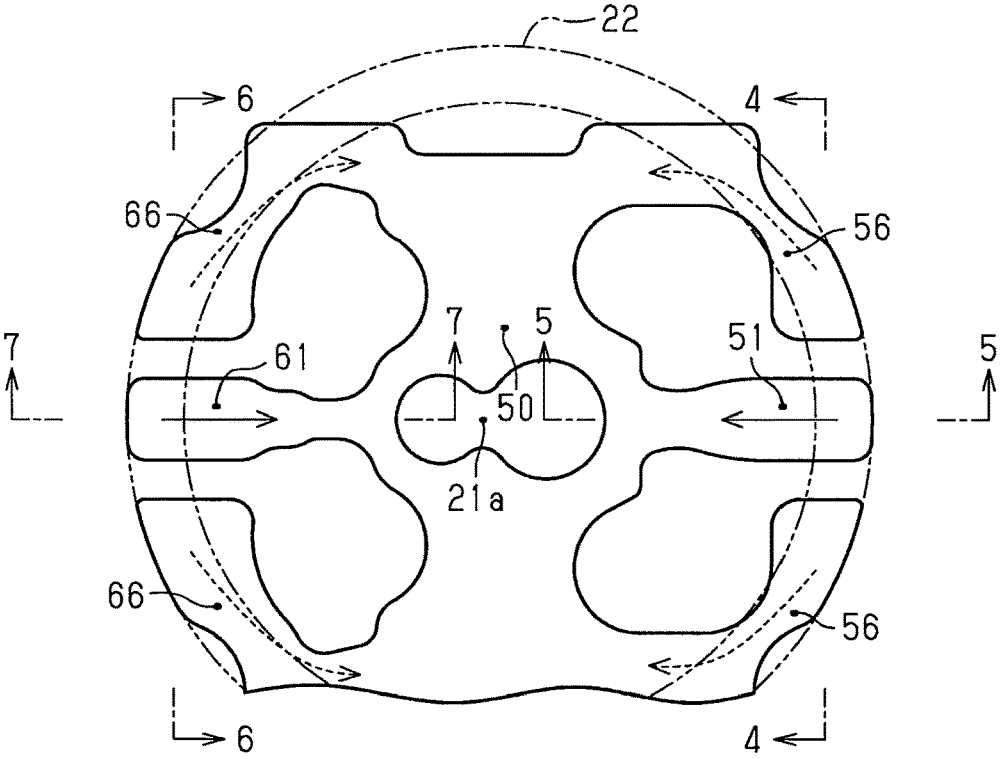
FIG. 3 is a diagram showing coolant passages arranged in the cylinder head of the internal combustion engine shown in FIG. 2.

FIG. 1 shows a part of coolant passages arranged in the cylinder head 30, as indicated by double-dashed lines. That is, as shown in FIGS. 1, 2, and 3, the cylinder head 30 includes a looped surrounding coolant passage 50 arranged around the central axis 21*a* of each cylinder 21, more specifically, around the ignition plug 13 and the fuel injection valve 14. The cylinder head 30 further includes an inter-exhaust port coolant passage 51 arranged between the paired exhaust ports 32 and an inter-intake port coolant passage 61 arranged between the paired intake ports 31. The inter-exhaust port coolant passage 51 and the inter-intake port coolant passage 61 are each configured so that coolant flows from outside to inside in a radial direction with respect to the central axis 21*a* of the cylinder 21, as indicated by solid arrows in FIG. 3. A downstream end of the inter-exhaust port coolant passage 51 and a downstream end of the inter-intake port coolant passage 61 are connected to the surrounding coolant passage 50. As shown in FIG. 2, the gasket 40 includes an exhaust communication portion 41, and the inter-exhaust port coolant passage 51 is connected to the block-side coolant passage 22 through the exhaust communication portion 41. In the same manner, the gasket 40 includes an intake communication portion 42, and the inter-intake port coolant passage 61 is connected to the block-side coolant passage 22 through the intake communication portion 42.

That is, when the pair of exhaust ports 32 is "a pair of specified ports," the exhaust communication portion 41 corresponds to an example of "a communication portion," and the inter-exhaust port coolant passage 51 corresponds to an example of "an inter-port coolant passage." When the pair of intake ports 31 is "a pair of specified ports," the intake communication portion 42 corresponds to an example of a "communication portion," and the inter-intake port coolant passage 61 corresponds to an example of "an inter-port coolant passage."

As shown in FIGS. 1 and 3, the cylinder head 30 includes two exhaust port outer passages 56 and two intake port outer passages 66 for each cylinder 21, and the exhaust port outer passages 56 and the intake port outer passages 66 are connected to the block-side coolant passage 22. The inter-exhaust port coolant passage 51 and each of the exhaust port outer passages 56 are arranged at opposite sides of the corresponding exhaust port 32 so as to sandwich the exhaust port 32 in the cylinder arrangement direction X. The coolant flowing from the block-side coolant passage 22 flows into the exhaust port outer passage 56 as indicated by dashed arrows in FIG. 3. The inter-intake port coolant passage 61 and each of the intake port outer passages 66 are arranged at opposite sides of the corresponding intake port 31 so as to sandwich the intake port 31 in the cylinder arrangement direction X. The coolant flowing from the block-side coolant passage 22 flows into the intake port outer passage 66 as indicated by dashed arrows in FIG. 3.

The two exhaust port outer passages 56 and the two intake port outer passages 66 are connected to the surrounding coolant passage 50 of the corresponding cylinder 21. In the cylinder head, the coolant passages (50, 51, 61, 56, 66) of the cylinders 21 that are adjacent to each other in the cylinder arrangement direction X are connected to each other. The coolant flowing from the block-side coolant passage 22 into the coolant passages in the cylinder head flows in a direction from a first longitudinal end of the cylinder head 30 toward a second longitudinal end of the cylinder head 30. The coolant flows out of the cylinder head 30 through an outlet (not shown) at the second longitudinal end of the cylinder head 30.

The inter-exhaust port coolant passage 51 will now be described in detail.

Figure 5:
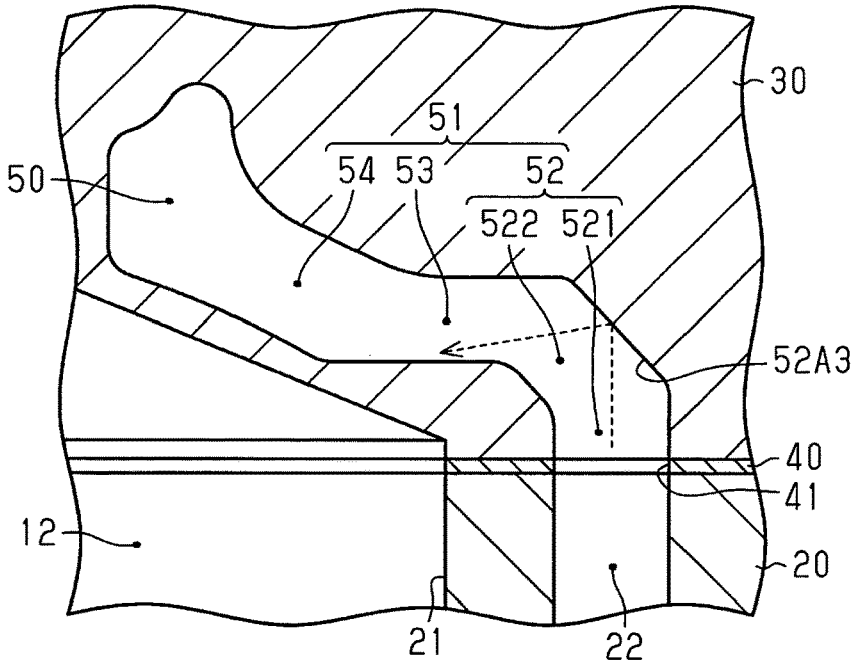
FIG. 5 is a cross-sectional view of the internal combustion engine taken along line 5-5 in FIG. 3.

As shown in FIGS. 2 and 5, the inter-exhaust port coolant passage 51 includes an upstream portion 52 connected to the exhaust communication portion 41, an intermediate portion 53 connected to a downstream end of the upstream portion 52, and a downstream portion 54 connected to a downstream end of the intermediate portion 53. As shown in FIG. 2, the upstream portion 52 is arranged at an outer side of the combustion chamber 12 in the radial direction with respect to the central axis 21*a* of the cylinder 21. The upstream portion 52 includes a vertical part 521 extending in an extension direction of the central axis 21*a* of the cylinder 21 and an inclined part 522 connected to a downstream end of the vertical part 521 (an upper end of the vertical part 521 in FIGS. 2 and 5). The inclined part 522 is inclined with respect to the central axis 21*a* of the cylinder 21. That is, the inclined part 522 extends radially inward from the vertical part 521 so that the inclined part 522 is closer to the central axis 21*a* of the cylinder 21 at positions further from the cylinder block 20.

Figure 4:
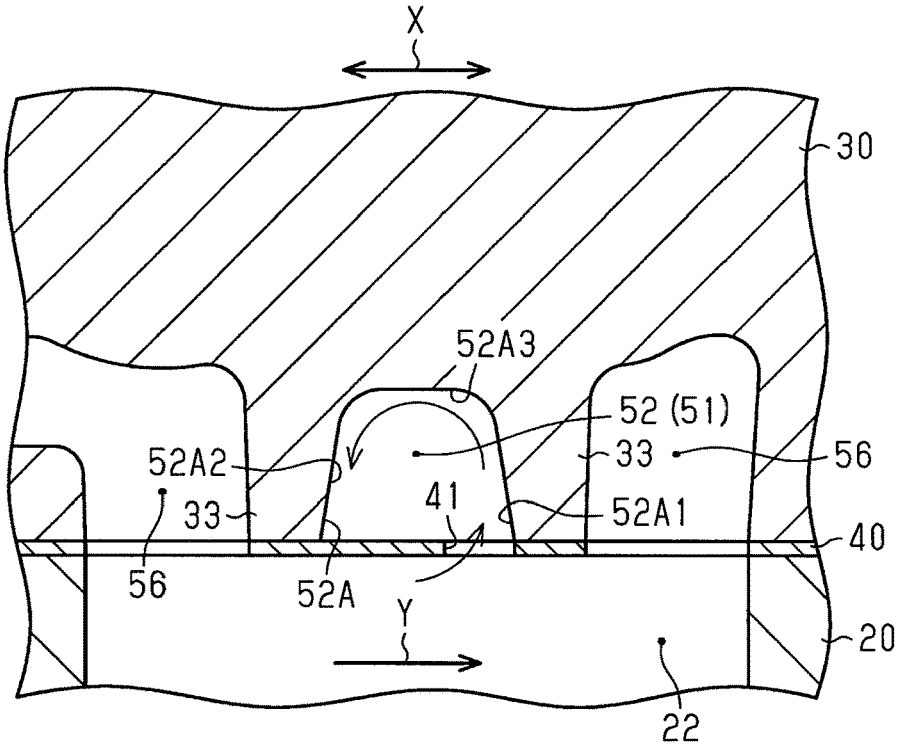
FIG. 4 is a cross-sectional view of the internal combustion engine taken along line 4-4 in FIG. 3.

As shown in FIG. 4, the passage cross section of the upstream portion 52 is rectangular. The direction in which the coolant flows in the block-side coolant passage 22 may be referred to as an in-block flow direction Y. In FIG. 4, the in-block flow direction Y substantially conforms to the cylinder arrangement direction X. The cylinder head 30 includes a peripheral wall 52A defining the upstream portion 52. The peripheral wall 52A includes two side surfaces 52A1 and 52A2 opposed to each other in the cylinder arrangement direction X. One of the two side surfaces 52A1 and 52A2 is referred to as a downstream side surface 52A1 arranged at the downstream side in the in-block flow direction Y. The other of the two side surfaces 52A1 and 52A2 is referred to as an upstream side surface 52A2 arranged at the upstream side in the in-block flow direction Y. The downstream side surface 52A1 extends upward in FIG. 4 so as to be closer to a central axis of the upstream portion 52. That is, the downstream side surface 52A1 extends in a direction away from the cylinder block 20 so as to be closer to the central axis of the upstream portion 52. In the same manner, the upstream side surface 52A2 extends upward in FIG. 4 so as to be closer to the central axis of the upstream portion 52. That is, the upstream side surface 52A2 extends in a direction away from the cylinder block 20 so as to be closer to the central axis of the upstream portion 52.

The peripheral wall 52A of the upstream portion 52 further includes an upper side surface 52A3. The downstream side surface 52A1 includes a first end and a second end that is separated from the cylinder block 20 further than the first end. The upstream side surface 52A2 also includes a first end and a second end that is separated from the cylinder block 20 further than the first end. The upper side surface 52A3 connects the second end of the downstream side surface 52A1 to the second end of the upstream side surface 52A2. The upper side surface 52A3 corresponds to an example of "a connecting side surface." The cross section of a portion connecting the upper side surface 52A3 and the downstream side surface 52A1 is arcuate. In the same manner, the cross section of a portion connecting the upper side surface 52A3 and the upstream side surface 52A2 is arcuate. The upper side surface 52A3 corresponds to a part of the peripheral wall of the inclined part 522 of the upstream portion 52 that is separated from the combustion chamber 12 further than the central axis of the inclined part 522. Thus, as shown in FIG. 2, the upper side surface 52A3 extends radially inward so as to be separated from the cylinder block 20. That is, the upper side surface 52A3 is inclined with respect to the central axis 21*a* of the cylinder 21.

As shown in FIG. 4, the upstream portion 52 is not connected to any of the two exhaust port outer passages 56. That is, the cylinder head 30 includes a portion functioning as an exhaust-side restriction portion 33 between the upstream portion 52 and each of the exhaust port outer passages 56. That is, each exhaust-side restriction portion 33 is a restriction portion or a restriction wall that defines the upstream portion 52 and the corresponding exhaust port outer passage 56. When coolant flows into the upstream portion 52 through the exhaust communication portion 41, the exhaust-side restriction portion 33 restricts outflow of the coolant to the exhaust port outer passage 56.

As shown in FIGS. 2 and 5, the intermediate portion 53 of the inter-exhaust port coolant passage 51 extends radially inward from the upstream portion 52. Specifically, the intermediate portion 53 extends radially inward from the inclined part 522. The extension direction of the intermediate portion 53 is substantially orthogonal to the extension direction of the central axis 21*a* of the cylinder 21. As shown in FIG. 2, an angle 811 formed by the central axis 21*a* of the cylinder 21 and a central axis of the intermediate portion 53 is larger than an angle 812 formed by the central axis 21*a* of the cylinder 21 and the central axis of the inclined part 522.

The downstream portion 54 of the inter-exhaust port coolant passage 51 is also connected to the surrounding coolant passage 50. That is, the downstream portion 54 connects the intermediate portion 53 to the surrounding coolant passage 50. Thus, when coolant flows into the upstream portion 52 of the inter-exhaust port coolant passage 51 through the exhaust communication portion 41, the coolant flows through the upstream portion 52, the intermediate portion 53, and the downstream portion 54 in this order and into the surrounding coolant passage 50.

FIG. 4 shows the positional relationship between the upstream portion 52 of the inter-exhaust port coolant passage 51 and the exhaust communication portion 41. The direction in which the coolant flows in a portion of the block-side coolant passage 22 that is connected to the exhaust communication portion 41 is referred to as the "in-block flow direction Y." As shown in FIG. 4, the center of the passage cross section of the exhaust communication portion 41 is shifted to the downstream side in the in-block flow direction Y with respect to the center of the passage cross section of the upstream portion 52 of the inter-exhaust port coolant passage 51. That is, the exhaust communication portion 41 is connected to the inter-exhaust port coolant passage 51 at a position shifted to the downstream side in the in-block flow direction Y with respect to the center of the passage cross section of the inter-exhaust port coolant passage 51. In the description herein, the passage cross section of the upstream portion 52 refers to a cross section obtained when the upstream portion 52 is cut along a plane orthogonal to the central axis of the upstream portion 52. That is, the central axis of the exhaust communication portion 41 is shifted to the downstream side in the in-block flow direction Y with respect to the central axis of the upstream portion 52. The passage cross section of the exhaust communication portion 41 is smaller in area than the passage cross section of the upstream end of the upstream portion 52. An inner wall surface of the exhaust communication portion 41 includes a portion substantially continuous with the downstream side surface 52A1 and is separated from the upstream side surface 52A2 toward the downstream side in the in-block flow direction Y.

The operation and effects of the present embodiment will now be described. Specifically, a description will be given of the operation and effects when the coolant flows from the block-side coolant passage 22 through the inter-exhaust port coolant passage 51 into the surrounding coolant passage 50.

As shown in FIG. 4, coolant flowing in the in-block flow direction Y flows through the exhaust communication portion 41 into the upstream portion 52 of the inter-exhaust port coolant passage 51. The center of the passage cross section of the exhaust communication portion 41 is shifted to the downstream side in the in-block flow direction Y with respect to the center of the passage cross section of the upstream portion 52. For this reason, when the coolant flows through the exhaust communication portion 41 into the upstream portion 52, a swirl flow of the coolant is readily generated along the peripheral wall 52A in the upstream portion 52, that is, the part of the inter-exhaust port coolant passage 51 connected to the exhaust communication portion 41, as indicated by the arrow in FIG. 4.

That is, when coolant flows through the exhaust communication portion 41 into the upstream portion 52, the coolant interfaces with the downstream side surface 52A1 of the peripheral wall 52A of the upstream portion 52. The coolant then flows along the downstream side surface 52A1 away from the cylinder block 20 and then interfaces with the upper side surface 52A3. After interfacing with the upper side surface 52A3, the coolant flows along the upper side surface 52A3 in the direction opposite to the in-block flow direction Y and interfaces with the upstream side surface 52A2. After interfacing with the upstream side surface 52A2, the coolant flows along the upstream side surface 52A2. As the coolant flows in the upstream portion 52 as described above, a swirl flow of the coolant is generated in the upstream portion 52. As a result, the flow of the coolant is less disturbed in the upstream portion 52 as compared to a case where the center of the passage cross section of the exhaust communication portion 41 is not shifted with respect to the center of the passage cross section of the upstream portion 52, that is, a case where the central axis of the exhaust communication portion 41 substantially coincides with the central axis of the upstream portion 52. That is, according to the present embodiment, when the position of the exhaust communication portion 41 is devised as described above, the flow of coolant is adjusted in the upstream portion 52. This reduces a pressure loss when the coolant flows into the upstream portion 52. Thus, the flow rate of the coolant flowing in the inter-exhaust port coolant passage 51 is increased.

In addition, according to the present embodiment, the passage cross section of the exhaust communication portion 41 is smaller in area than the passage cross section of the upstream end of the upstream portion 52. Such a reduction in the area of the passage cross section of the exhaust communication portion 41 increases in the flow rate of the coolant flowing through the exhaust communication portion 41 into the inter-exhaust port coolant passage 51. This enhances the increase in the flow rate of coolant flowing in the inter-exhaust port coolant passage 51.

According to the present embodiment, the cooling efficiency of the combustion chamber 12 is enhanced by increasing the flow rate of coolant flowing in the inter-exhaust port coolant passage 51.

The downstream side surface 52A1 of the peripheral wall 52A of the upstream portion 52 extends in a direction away from the cylinder block 20 so as to be closer to the central axis of the upstream portion 52. The cross section of the portion connecting the downstream side surface 52A1 and the upper side surface 52A3 is arcuate. Thus, when coolant flows along the downstream side surface 52A1, interfaces with the upper side surface 52A3, and then flows along the upper side surface 52A3, decreases in the flow rate of the coolant are limited as compared to a case where the downstream side surface 52A1 is not inclined. This limits decreases in the flow rate of the swirl flow in the upstream portion 52.

The upstream side surface 52A2 extends in a direction away from the cylinder block 20 so as to be closer to the central axis of the upstream portion 52. The cross section of the portion connecting the upper side surface 52A3 and the upstream side surface 52A2 is arcuate. Thus, when coolant flows along the upper side surface 52A3, interfaces with the upstream side surface 52A2, and then flows along the upstream side surface 52A2, decreases in the flow rate of coolant are limited as compared to a case where the upstream side surface 52A2 is not inclined. This limits decreases in the flow rate of a swirl flow in the upstream portion 52.

As shown in FIG. 5, the inclined part 522 of the upstream portion 52 is inclined with respect to the extension direction of the intermediate portion 53. That is, the inclined part 522 extends so as to be separated from the cylinder block 20 toward the intermediate portion 53 and is connected to the intermediate portion 53. Thus, a part of the peripheral wall of the inclined part 522 of the upstream portion 52 that is separated from the combustion chamber 12 further than the central axis of the inclined part 522, that is, the upper side surface 52A3, is inclined with respect to the extension direction of the intermediate portion 53. As indicated by a broken arrow in FIG. 5, in the inter-exhaust port coolant passage 51, the coolant flowing in the upstream portion 52 is guided by the upper side surface 52A3 to an area in the intermediate portion 53 that is closer to the combustion chamber 12 than the central axis of the intermediate portion 53. This increases the amount of coolant flowing in the area in the intermediate portion 53 that is closer to the combustion chamber 12 than the central axis of the intermediate portion 53. Thus, the cooling efficiency of the combustion chamber 12 is further enhanced.

According to the present embodiment, as shown in FIG. 4, each exhaust-side restriction portion 33 is arranged between the upstream portion 52 and the corresponding exhaust port outer passage 56. Thus, the coolant flowing through the exhaust communication portion 41 into the upstream portion 52 does not flow out to the exhaust port outer passage 56. This limits decreases in the flow rate of coolant flowing in the inter-exhaust port coolant passage 51 as compared to a case where the coolant is allowed to flow out of the upstream portion 52 to the exhaust port outer passage 56. This limits adverse effects on the cooling efficiency of the combustion chamber 12.

The inter-intake port coolant passage 61 will now be described in detail.

Figure 7:
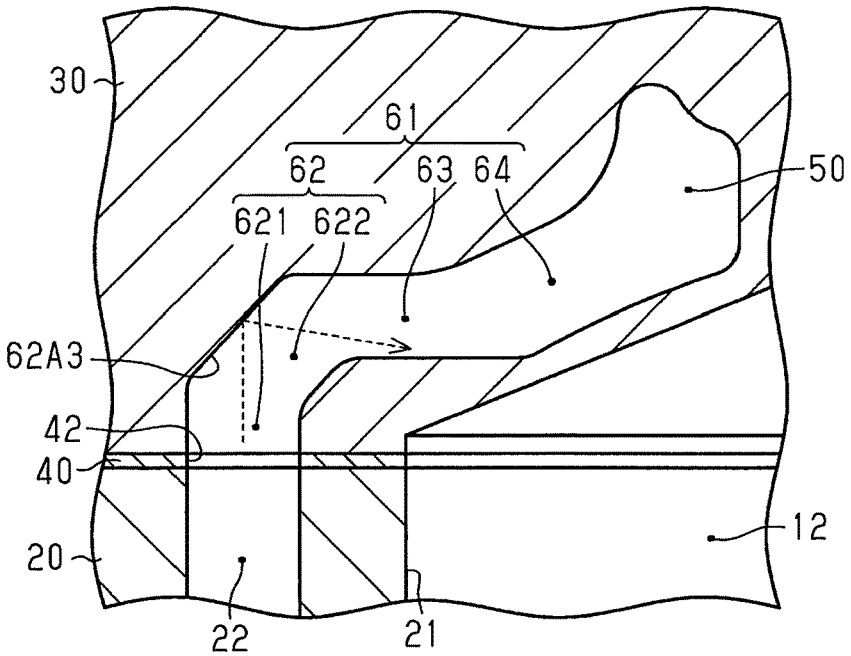
FIG. 7 is a cross-sectional view of the internal combustion engine taken along line 7-7 in FIG. 3.

As shown in FIGS. 2 and 7, the inter-intake port coolant passage 61 includes an upstream portion 62 connected to the intake communication portion 42, an intermediate portion 63 connected to a downstream end of the upstream portion 62, and a downstream portion 64 connected to a downstream end of the intermediate portion 63. As shown in FIG. 7, the upstream portion 62 is arranged at an outer side of the combustion chamber 12 in the radial direction. The upstream portion 62 includes a vertical part 621 extending in the extension direction of the central axis 21*a* of the cylinder 21 and an inclined part 622 connected to a downstream end of the vertical part 621 (an upper end of the vertical part 621 in FIGS. 2 and 7). The inclined part 622 is inclined with respect to the central axis 21*a* of the cylinder 21. That is, the inclined part 622 extends radially inward from the vertical part 621 so as to be closer to the central axis 21*a* of the cylinder 21 at positions further from the cylinder block 20.

Figure 6:
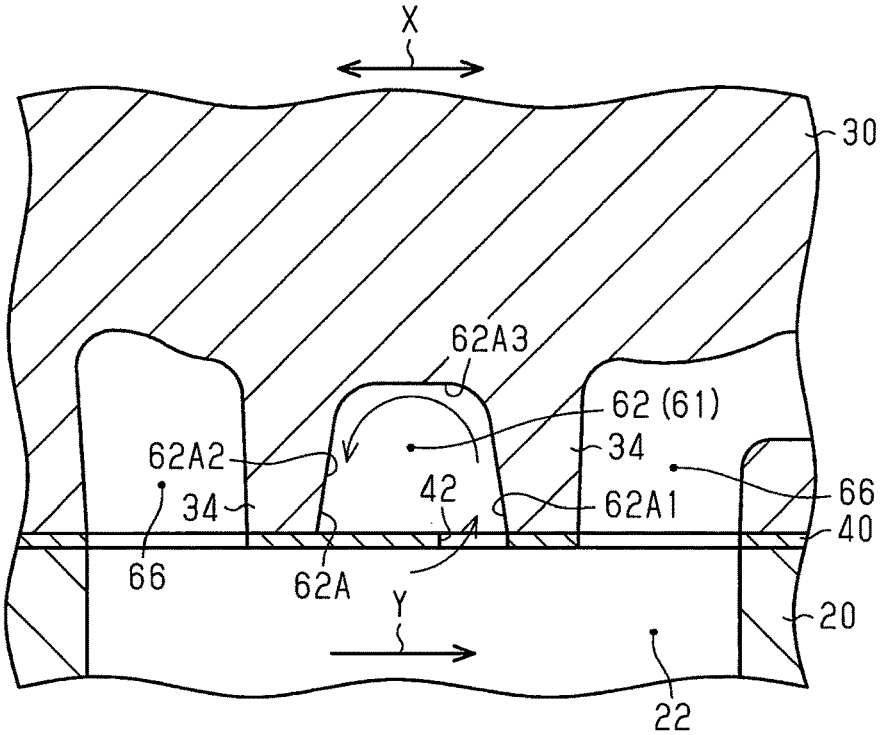
FIG. 6 is a cross-sectional view of the internal combustion engine taken along line 6-6 in FIG. 3.

As shown in FIG. 6, the passage cross section of the upstream portion 62 is rectangular. In FIG. 6, the in-block flow direction Y substantially conforms to the cylinder arrangement direction X. The cylinder head 30 includes a peripheral wall 62A defining the upstream portion 62. The peripheral wall 62A includes two side surfaces 62A1 and 62A2 opposed to each other in the cylinder arrangement direction X. One of the two side surfaces 62A1 and 62A2 is referred to as a downstream side surface 62A1 arranged at the downstream side in the in-block flow direction Y. The other of the two side surfaces 62A1 and 62A2 is referred to as an upstream side surface 62A2 arranged at the upstream side in the in-block flow direction Y. The downstream side surface 62A1 extends upward in FIG. 6 so as to be closer to a central axis of the upstream portion 62. That is, the downstream side surface 62A1 extends in a direction away from the cylinder block 20 so as to be closer to the central axis of the upstream portion 62. In the same manner, the upstream side surface 62A2 extends upward in FIG. 6 so as to be closer to the central axis of the upstream portion 62. That is, the upstream side surface 62A2 extends in a direction away from the cylinder block 20 so as to be closer to the central axis of the upstream portion 62.

The peripheral wall 62A of the upstream portion 62 further includes an upper side surface 62A3. The downstream side surface 62A1 includes a first end and a second end that is separated from the cylinder block 20 further than the first end. The upstream side surface 62A2 also includes a first end and a second end that is separated from the cylinder block 20 further than the first end. The upper side surface 62A3 connects the second end of the downstream side surface 62A1 to the second end of the upstream side surface 62A2. The upper side surface 62A3 corresponds to an example of "a connecting side surface." The cross section of a portion connecting the upper side surface 62A3 and the downstream side surface 62A1 is arcuate. In the same manner, the cross section of a portion connecting the upper side surface 62A3 and the upstream side surface 62A2 is arcuate. The upper side surface 62A3 corresponds to a part of the peripheral wall of the inclined part 622 of the upstream portion 62 that is separated from the combustion chamber 12 further than the central axis of the inclined part 622. Thus, as shown in FIG. 2, the upper side surface 62A3 extends radially inward so as to be separated from the cylinder block 20. That is, the upper side surface 62A3 is inclined with respect to the central axis 21*a* of the cylinder 21.

As shown in FIG. 6, the upstream portion 62 is not connected to any of the two intake port outer passages 66. That is, the cylinder head 30 has a portion functioning as an intake-side restriction portion 34 between the upstream portion 62 and each of the two intake port outer passages 66. That is, each intake-side restriction portion 34 is a restriction portion or a restriction wall that defines the upstream portion 62 and the corresponding intake port outer passage 66. When coolant flows into the upstream portion 62 through the intake communication portion 42, the intake-side restriction portion 34 restricts outflow of the coolant to the intake port outer passage 66.

As shown in FIGS. 2 and 7, the intermediate portion 63 of the inter-intake port coolant passage 61 extends radially inward from the upstream portion 62. Specifically, the intermediate portion 63 extends radially inward from the inclined part 622. The extension direction of the intermediate portion 63 is substantially orthogonal to the extension direction of the central axis 21*a* of the cylinder 21. As shown in FIG. 2, an angle 821 formed by the central axis 21*a* of the cylinder 21 and a central axis of the intermediate portion 63 is larger than an angle 822 formed by the central axis 21*a* of the cylinder 21 and the central axis of the inclined part 622.

The downstream portion 64 of the inter-intake port coolant passage 61 is also connected to the surrounding coolant passage 50. That is, the downstream portion 64 connects the intermediate portion 63 to the surrounding coolant passage 50. Thus, when coolant flows into the upstream portion 62 of the inter-intake port coolant passage 61 through the intake communication portion 42, the coolant flows through the upstream portion 62, the intermediate portion 63, and the downstream portion 64 in this order and into the surrounding coolant passage 50.

FIG. 6 shows the positional relationship between the upstream portion 62 of the inter-intake port coolant passage 61 and the intake communication portion 42. The direction in which the coolant flows in a portion of the block-side coolant passage 22 that is connected to the intake communication portion 42 is referred to as an "in-block flow direction Y." As shown in FIG. 6, the center of the passage cross section of the intake communication portion 42 is shifted to the downstream side in the in-block flow direction Y with respect to the center of the passage cross section of the upstream portion 62. That is, the intake communication portion 42 is connected to the inter-intake port coolant passage 61 at a position shifted to the downstream side in the in-block flow direction Y with respect to the center of the passage cross section of the inter-intake port coolant passage 61. In the description herein, the passage cross section of the upstream portion 62 is a cross section obtained when the upstream portion 62 is cut along a plane orthogonal to the central axis of the upstream portion 62. That is, the central axis of the intake communication portion 42 is shifted to the downstream side in the in-block flow direction Y with respect to the central axis of the upstream portion 62. The passage cross section of the intake communication portion 42 is smaller in area than the passage cross section of the upstream end of the upstream portion 62. An inner wall surface of the intake communication portion 42 includes a portion substantially continuous with the downstream side surface 62A1 and is separated from the upstream side surface 62A2 toward the downstream side in the in-block flow direction Y.

The operation and effects of the present embodiment will now be described. Specifically, a description will be given of the operation and effects when the coolant flows from the block-side coolant passage 22 through the inter-intake port coolant passage 61 into the surrounding coolant passage 50.

As shown in FIG. 6, coolant flowing in the in-block flow direction Y flows through the intake communication portion 42 into the upstream portion 62 of the inter-intake port coolant passage 61. The center of the passage cross section of the intake communication portion 42 is shifted to the downstream side in the in-block flow direction Y with respect to the center of the passage cross section of the upstream portion 62. For this reason, when coolant flows through the intake communication portion 42 into the upstream portion 62, a swirl flow of coolant is readily generated along the peripheral wall 62A of the upstream portion 62, as indicated by the arrow in FIG. 6.

That is, when coolant flows through the intake communication portion 42 into the upstream portion 62, the coolant interfaces with the downstream side surface 62A1 of the peripheral wall 62A of the upstream portion 62. The coolant then flows along the downstream side surface 62A1 so as to be separated from the cylinder block 20 and then interfaces with the upper side surface 62A3. After interfacing with the upper side surface 62A3, the coolant flows along the upper side surface 62A3 in the direction opposite to the in-block flow direction Y and interfaces with the upstream side surface 62A2. After interfacing with the upstream side surface 62A2, the coolant flows along the upstream side surface 62A2. When the coolant flows in the upstream portion 62 as described above, a swirl flow of coolant is generated in the upstream portion 62. As a result, the flow of the coolant is less disturbed in the upstream portion 62 as compared to a case where the center of the passage cross section of the intake communication portion 42 is not shifted with respect to the center of the passage cross section of the upstream portion 62, that is, a case where the central axis of the intake communication portion 42 substantially coincides with the central axis of the upstream portion 62. That is, according to the present embodiment, a swirl flow of the coolant is generated in the upstream portion 62 by devising the position of the intake communication portion 42 as described above. This reduces a pressure loss when the coolant flows into the upstream portion 62. Thus, the flow rate of coolant flowing in the inter-intake port coolant passage 61 is increased.

In addition, according to the present embodiment, the passage cross section of the intake communication portion 42 is smaller in area than the passage cross section of the upstream end of the upstream portion 62. Such a reduction in the area of the passage cross section of the intake communication portion 42 increases the flow rate of coolant flowing through the intake communication portion 42 into the inter-intake port coolant passage 61. This enhances the increase in the flow rate of coolant flowing in the inter-intake port coolant passage 61.

According to the present embodiment, the cooling efficiency of the combustion chamber 12 is enhanced by increasing the flow rate of coolant flowing in the inter-intake port coolant passage 61.

The downstream side surface 62A1 of the peripheral wall 62A of the upstream portion 62 extends in a direction away from the cylinder block 20 so as to be closer to the central axis of the upstream portion 62. The cross section of the portion connecting the downstream side surface 62A1 and the upper side surface 62A3 is arcuate. For this reason, when coolant flows into the upstream portion 62, the coolant readily flows along the peripheral wall 62A of the upstream portion 62. This limits decreases in the flow rate of a swirl flow in the upstream portion 62.

The upstream side surface 62A2 extends in a direction away from the cylinder block 20 so as to be closer to the central axis of the upstream portion 62. The cross section of the portion connecting the upper side surface 62A3 and the upstream side surface 62A2 is arcuate. Thus, when the coolant flows along the upper side surface 62A3, interfaces with the upstream side surface 62A2, and then flows along the upstream side surface 62A2, decreases in the flow rate of the coolant are limited as compared to a case where the upstream side surface 62A2 is not inclined. This limits decreases in the flow rate of a swirl flow in the upstream portion 62.

As shown in FIG. 7, the inclined part 622 of the upstream portion 62 is inclined with respect to the extension direction of the intermediate portion 63. That is, the inclined part 622 extends so as to be separated from the cylinder block 20 toward the intermediate portion 63 and is connected to the intermediate portion 63. Thus, a part of the peripheral wall of the inclined part 622 of the upstream portion 62 that is separated from the combustion chamber 12 further than the central axis of the inclined part 622, that is, the upper side surface 62A3, is inclined with respect to the extension direction of the intermediate portion 63. As indicated by a broken arrow in FIG. 7, in the inter-intake port coolant passage 61, the coolant flowing in the upstream portion 62 is guided by the upper side surface 62A3 to an area in the intermediate portion 63 that is closer to the combustion chamber 12 than the central axis of the intermediate portion 63. This increases the amount of coolant flowing in the area in the intermediate portion 63 that is closer to the combustion chamber 12 than the central axis of the intermediate portion 63. Thus, the cooling efficiency of the combustion chamber 12 is further enhanced.

According to the present embodiment, as shown in FIG. 6, each intake-side restriction portion 34 is arranged between the upstream portion 62 and the corresponding intake port outer passage 66. Thus, the coolant flowing through the intake communication portion 42 into the upstream portion 62 does not flow out to the intake port outer passage 66. This limits decreases in the flow rate of coolant flowing in the inter-intake port coolant passage 61 as compared to a case where the coolant is allowed to flow out of the upstream portion 62 to the intake port outer passage 66. This limits adverse effects on the cooling efficiency of the combustion chamber 12.

The embodiment described above may be modified as follows. The embodiment described above and the following modified examples may be implemented in combination without causing technical contradictions.

As long as the center of the passage cross section of the exhaust communication portion 41 is shifted to the downstream side in the in-block flow direction Y with respect to the center of the passage cross section of the upstream portion 52 of the inter-exhaust port coolant passage 51, the center of the passage cross section of the intake communication portion 42 does not need to be shifted to the downstream side in the in-block flow direction Y with respect to the center of the passage cross section of the upstream portion 62 of the inter-intake port coolant passage 61. That is, the central axis of the intake communication portion 42 may substantially coincide with the central axis of the upstream portion 62.

As long as the center of the passage cross section of the intake communication portion 42 is shifted to the downstream side in the in-block flow direction Y with respect to the center of the passage cross section of the upstream portion 62 of the inter-intake port coolant passage 61, the center of the passage cross section of the exhaust communication portion 41 does not need to be shifted to the downstream side in the in-block flow direction Y with respect to the center of the passage cross section of the upstream portion 52 of the inter-exhaust port coolant passage 51. That is, the central axis of the exhaust communication portion 41 may substantially coincide with the central axis of the upstream portion 52.

In the embodiment described above, the downstream side surface 52A1 of the peripheral wall 52A of the upstream portion 52 of the inter-exhaust port coolant passage 51 is inclined as shown in FIG. 4. However, the downstream side surface 52A1 does not need to be inclined.

In the embodiment described above, the downstream side surface 62A1 of the peripheral wall 62A of the upstream portion 62 of the inter-intake port coolant passage 61 is inclined as shown in FIG. 6. However, the downstream side surface 62A1 does not need to be inclined.

The cylinder head 30 may be configured so that the coolant is allowed to slightly flow between the upstream portion 52 of the inter-exhaust port coolant passage 51 and each of the exhaust port outer passages 56.

The cylinder head 30 may be configured so that the coolant is allowed to slightly flow between the upstream portion 62 of the inter-intake port coolant passage 61 and each of the intake port outer passages 66.

The upstream portion 52 of the inter-exhaust port coolant passage 51 does not need to include the inclined part 522.

The upstream portion 62 of the inter-intake port coolant passage 61 does not need to include the inclined part 622.

One or both of the two exhaust port outer passages 56 may be removed. One or both of the two intake port outer passages 66 may be removed.

The internal combustion engine 10 may be of a side injection type in which the intake port 31 is arranged between the ignition plug 13 and a fuel injection valve. The internal combustion engine 10 may include a fuel injection valve that injects fuel into the intake port 31 instead of a fuel injection valve that directly injects fuel into the combustion chamber 12. The internal combustion engine 10 may be a diesel internal combustion engine.

Therefore, the present examples and embodiments are to be considered as illustrative and not restrictive and the invention is not to be limited to the details given herein, but may be modified within the scope and equivalence of the appended claims.

The invention claimed is:

1. An internal combustion engine comprising:

a plurality of cylinders;

a cylinder head that includes a pair of intake ports and a pair of exhaust ports for each of the plurality of cylinders; and a cylinder block that includes a block-side coolant passage, wherein:

the cylinder head is configured to allow coolant to flow from the block-side coolant passage into the cylinder head, one of the pair of intake ports and the pair of exhaust ports is a pair of specified ports, the cylinder head includes an inter-port coolant passage between the pair of specified ports, wherein in the inter-port coolant passage, the coolant flows inward in a radial direction with respect to a central axis of each of the plurality of cylinders, the inter-port coolant passage is connected to the block-side coolant passage by a communication passage, which directly connects the inter-port coolant passage and the block-side coolant passage such that all coolant flowing through the communication passage flows into the inter-port coolant passage, a flow direction is a direction in which the coolant flows in a portion of the block-side coolant passage that is connected to the communication passage, and a center of a passage cross-section of the communication passage is shifted to a downstream side in the flow direction with respect to a center of a passage cross-section of the inter-port coolant passage.

2. The internal combustion engine according to claim 1, wherein:

the cylinder head further includes a surrounding coolant passage arranged around the central axis of each cylinder at an inner side of the communication passage in the radial direction, the inter-port coolant passage includes:

an upstream portion that is connected to the communication passage;

an intermediate portion that is arranged at an inner side of the communication passage in the radial direction and connected to the upstream portion, the intermediate portion extending inward from the upstream portion in the radial direction; and a downstream portion that connects the intermediate portion to the surrounding coolant passage, the upstream portion includes an inclined part connected to the intermediate portion, the inclined part extending so as to be separated from the cylinder block toward the intermediate portion, and a central axis of the inclined part is inclined with respect to the central axis of each cylinder, and an angle formed by the central axis of each cylinder and a central axis of the intermediate portion is larger than an angle formed by the central axis of each cylinder and the central axis of the inclined part.

3. The internal combustion engine according to claim 1, wherein:

a cylinder arrangement direction is a direction in which the cylinders are arranged in the cylinder block, the cylinder head further includes a port outer passage into which the coolant flows from the block-side coolant passage, the port outer passage and the inter-port coolant passage are disposed at opposite sides of one of the specified ports in the cylinder arrangement direction, the inter-port coolant passage includes an upstream portion that is connected to the communication passage, and the cylinder head further includes a restriction portion defining the upstream portion and the port outer passage and restricting a flow of the coolant out of the upstream portion toward the port outer passage.

4. The internal combustion engine according to claim 1, wherein:

a cylinder arrangement direction is a direction in which the cylinders are arranged in the cylinder block, the inter-port coolant passage includes an upstream portion that is connected to the communication passage, the cylinder head further includes a peripheral wall defining the upstream portion, the peripheral wall includes two side surfaces opposed to each other in the cylinder arrangement direction, each of the two side surfaces includes a first end and a second end that is separated from the cylinder block further than the first end, the peripheral wall further includes a connecting side surface that connects the second ends of the two side surfaces, one of the two side surfaces is a downstream side surface that is arranged at a downstream side in the flow direction, and the downstream side surface extends from the first end to the second end so as to be closer to a central axis of the upstream portion.

5. The internal combustion engine according to claim 1, wherein:

a gasket is arranged between the cylinder block and the cylinder head, and the gasket includes the communication passage.

6. The internal combustion engine according to claim 1, wherein the pair of specified ports is the pair of exhaust ports.

7. The internal combustion engine according to claim 1, wherein:

the inter-port coolant passage includes an upstream portion that is connected to the communication passage, and the passage cross-section of the communication passage is smaller in area than a passage cross-section of an upstream end of the upstream portion.

8. The internal combustion engine according to claim 1, wherein:

the inter-port coolant passage includes an upstream portion that is connected to the communication passage, the cylinder head further includes a peripheral wall defining the upstream portion, the peripheral wall includes two side surfaces opposed to each other in the flow direction, one of the two side surfaces is a downstream side surface that is arranged at a downstream side in the flow direction, the other of the two side surfaces is an upstream side surface that is arranged at an upstream side in the flow direction, and the communication passage includes an inner wall surface that includes a portion substantially continuous with the downstream side surface and is separated from the upstream side surface toward the downstream side in the flow direction.

* * * * *